United States Patent [19]

Ferdi

[11] Patent Number: 4,896,377

[45] Date of Patent: Jan. 30, 1990

[54] GARMENT HAVING AN INTEGRAL HANGER FOR EYEGLASSES

[76] Inventor: Allan W. Ferdi, 2207 Zollinger Rd., Columbus, Ohio 43221

[21] Appl. No.: 247,653

[22] Filed: Sep. 22, 1988

[51] Int. Cl.[4] ..... A41D 27/08; A41B 1/08

[52] U.S. Cl. ..... 2/115; 2/106; 2/250; 2/271

[58] Field of Search ..... 2/106, 113, 118, 115, 2/250, 251, 254, 257, 101, 217, 271

[56] References Cited

U.S. PATENT DOCUMENTS

| | | | |
|---|---|---|---|
| 497,638 | 5/1893 | Diefenbach | 2/254 |
| 555,227 | 2/1896 | Teuber et al. | 2/254 |
| 1,213,894 | 1/1917 | Nelson | 2/251 |
| 1,649,225 | 11/1927 | Grundmann | 2/250 |
| 2,079,980 | 5/1937 | Anders | 2/115 |
| 2,244,167 | 6/1941 | McGee | 2/115 |
| 2,551,863 | 5/1951 | Young | 2/115 |
| 2,624,050 | 1/1953 | Boller | 2/115 |
| 4,665,564 | 5/1987 | Bogart et al. | 2/115 X |

*Primary Examiner*—Werner H. Schroeder
*Assistant Examiner*—Jeanette E. Chapman
*Attorney, Agent, or Firm*—Thomas S. Baker, Jr

[57] ABSTRACT

An integral strip of fabric fastened at both ends to the front of a garment adapted to form a horizontally extending eyeglass hanger strip and cooperative with said garment to define a temple receiving opening for a pair of glasses.

8 Claims, 1 Drawing Sheet

GARMENT HAVING AN INTEGRAL HANGER FOR EYEGLASSES

BACKGROUND OF THE INVENTION

A large percentage of the population wear eyeglasses. Some of these people must wear eyeglasses at all times while others only need to wear glasses occasionally. Among the latter group of people are those who wear eyeglasses as a fashionable accessory with certain clothing and people who wear special purpose eyeglasses such as sun glasses, reading glasses, bifocals, trifocals, etc.

People who wear glasses only occasionally frequently carry the glasses with them and in some instances people who must wear eyeglasses at all times carry an extra pair of eyeglasses.

A problem which sometimes confronts people that carry eyeglasses with them involves how to transport these glasses. If an individual wears a suit or sport coat the glasses may be carried in a pocket. If the individual carries a pocketbook the glasses may be transported therein. However, on those occasions where an individual does not wear some type of coat or carry a pocketbook their options for ways to carry glasses become limited. In most instances the individual will carry a case containing the eyeglasses in a pants or shirt pocket. Unfortunately, eyeglass cases are bulky, obtrusive and somewhat annoying to carry. Additionally if a person carries glasses in a pant's pocket they may be broken when the person sits down.

Some attempts have been made to provide auxiliary holders for eyeglasses which may be attached to an article of clothing. One example of an auxiliary eyeglass holder may be seen in U.S. Pat. No. 4,458,384 to Arnold. In this holder a curved, metal body member is adapted to be affixed to a garment by a pin type of fastener. The curved body member defines a pair of closed loops at each end thereof. When the holder has been fastened to a user's garment the loops project laterally from the garment and are adapted to receive one temple of a pair of eyeglasses. One problem with such a device resides in the fact that the temple contained in the holder will be rigidly retained therein and if the user bends or makes a sudden movement the bridge of the glasses may pivot away from the temple which may allow the unrestrained temple also to pivot with respect to the bridge and lock into an open position. When this occurs the unrestrained temple wedges against the garment and causes the glasses to project laterally away from the body of the wearer. In this position the glasses may fall out of the holder entirely. Additionally, such an auxiliary holder further requires a user to put pin holes in his garment and subjects the garment to possible stains in the event the holder starts to rust.

An accessory carrier for use on garments which may accommodate eyeglasses may be seen in U.S. Pat. No. 4,051,554 to Kallman. The Kallman device includes a flap adapted to be attached at one end to the shoulder of an outer garment such as a jacket and having a second end which pivots between a storage position in which the second end attaches to a first point on the jacket and the flap lies flat against the shoulder of the garment and an operative position in which the second end extends vertically around the accessory such as eyeglasses and attaches to a second point on the garment. In this manner the eyeglasses are attached to the shoulder of the garment and project laterally therefrom. The Kallman accessory holder appears to be adapted primarily for use on an article of outer clothing such as a ski jacket, a motorcycle jacket or a scuba diving jacket. The Kallman accessory holder would not be suitable for use on sports or dress shirts or on blouses because of the prominent position in which the eyeglasses project laterally from the body of the wearer and because of the relatively large size and obtrusive nature of the flap which makes it most suitable for use with large items such as goggles and less suitable for smaller items which as eyeglasses.

Ideally a garment would be provided with an unobtrusive integral device for transporting a pair of eyeglasses in such a manner that the glasses rest firmly against the body of the wearer, the temples remain folded and parallel to the bridge at all times and the device would be relative small and unobtrusive and suitable for use on dress and sports shirts and blouses.

SUMMARY OF THE INVENTION

The present invention covers a fabric garment adapted to be worn about the upper body portion of a person having an integral strip of fabric fastened at both ends to the front of the garment to form a horizontally extending eyeglass hanger strip. This strip cooperates with the garment to define a temple receiving opening for a pair of glasses having a bridge for mounting a pair of lenses and a temple pivotally attached to each end of the bridge and movable between a first position in which the temple extends parallel to the bridge and a second position in which the hanger extends perpendicular to the bridge. The hanger strip has a length greater than one-half the perimeter of the temple of a pair of glasses taken at the greatest cross-sectional area of a temple to thereby enable the person to insert a single temple of the glasses into the opening defined by the strip and the garment when the temple is at an acute angle with respect to the bridge portion of the glasses and wherein the integral strip permits the glasses to pivot at the joint between the temple and the bridge as a unit about the hanger strip.

DESCRIPTION OF THE PREFERRED EMBODIMENT

Figure 1:
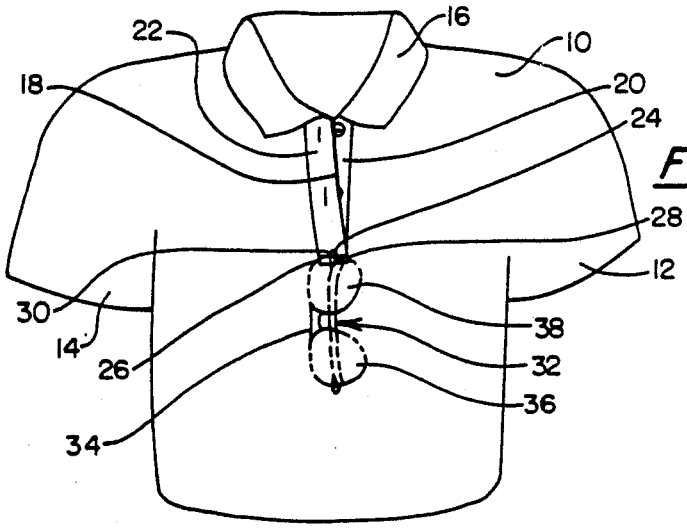
FIG. 1 is a front view showing the eyeglass hanger strip of the present invention extending horizontally along the lower edge of a placket extending vertically partially down the front of the garment.

Turning to FIG. 1, a sport shirt or garment (10) has a pair of sleeves (12) and (14), a collar (16) and a placket (18) defining a vertical opening extending part way down the front of the garment to enable the garment to be drawn over the head of a wearer. A vertical button strip (20) having a plurality of spaced buttons and a vertical buttonhole strip (22) having a plurality of spaced buttonholes for receipt of the buttons on strip (20) define the placket (18). Buttons on button strip (20) may be placed through buttonholes on buttonhole strip (22) to partially close the opening of placket (18).

A horizontally extending fabric strip (24) has each end thereof (26) and (28) fastened along the bottom edge of the button strip (20) to thereby provide the eyeglass hanger (24) of the present invention. An opening defined between the eyeglass hanger strip (24) and the garment itself is adapted to receive a temple (30) of a pair of eyeglasses (32) having a bridge (34) which receives a pair of lenses (36) and (38), and temples (30) and (40) pivotally attached at each end thereof. The temples (30) and (40) are movable between a position in which the temples extend parallel to the bridge (34) and a position in which the temples extend perpendicular to the bridge (34).

It has been found desirable to limit the width of the eyeglass hanger strip (24) to enable the glasses to pivot as a unit about the pivotal juncture of the temple (30) passing through the fabric strip defining the eyeglass hanger (24) and the eyeglass temple (30). It has been discovered that if the width of the eyeglass hanger (24) becomes excessive or if the hanger strip (24) engages the temple (30) too firmly the temple (30) will be restrained and the eyeglasses (32) will pivot about the connection between the bridge (34) and the temple (30) while the temple (30) remains flat against the chest of the wearer of the garment (10). When this occurs the eyeglasses (32) may pivot sufficiently to enable the temple (40) which is pivoted into alignment with the bridge (34) to fall downwardly under the force of gravity and pivot to a position in which it extends perpendicular to the bridge (34). Of course, when this occurs the eyeglasses (32) will project outwardly from the chest of the wearer in an undesirable manner and allow the eyeglasses to fall out of the hanger.

It has been found desirable to have the width of the hanger strip not exceed 0.500 inches.

Figure 2:
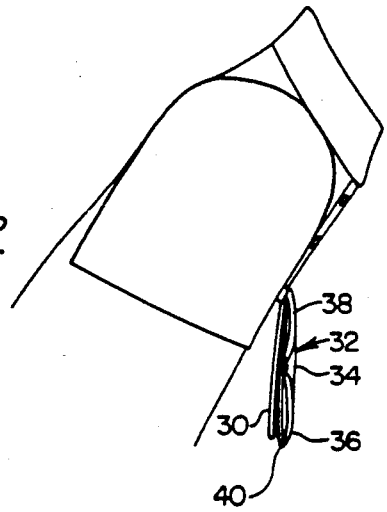
FIG. 2 provides a side view of the garment of FIG. 1 illustrating the pivotal movement of the eyeglasses as a unit about the hanger strip of the present invention.

Turning to FIG. 2, it may be seen that when the temple (30) of a pair of eyeglasses (32) has been inserted into the space between the fabric strip defining eyeglass hanger (24) and the garment (10) the eyeglasses (32) will pivot as a unit when they are moved away from the body of a wearer. In other words, the temples (30) and (40) remain in a position in which they are parallel with the bridge (34) of the eyeglasses (32) during movement of the eyeglasses away from the body of the wearer.

Figure 3:
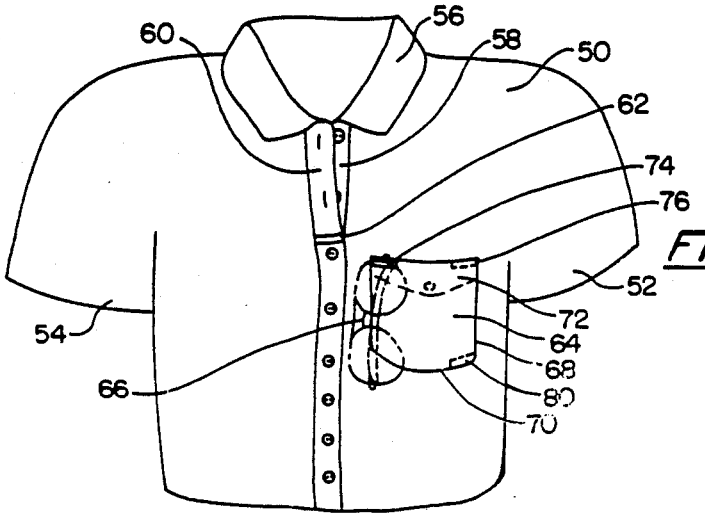
FIG. 3 is a front view of a garment having a vertically extending central opening which may be closed by buttons and showing hanger strips of the present invention mounted on the buttonhole defining strip, along the top edge of a pocket and along the bottom edge of a pocket on the front of the garment.

Turning to FIG. 3, a dress shirt or garment (50) having a pair of sleeves (52) and (54) and a collar (56) has a central vertical opening which extends the entire length of the front of the shirt. This opening enables a wearer to don the garment. A button strip (58) having a plurality of spaced buttons defines one side of the vertical opening and a buttonhole strip (60) having a plurality of buttonholes adapted to receive the buttons along strip (58) defines the opposite side of the vertical opening. Buttons along the strip (58) are adapted to be received within the holes defined in strip (60) to thereby enable a wearer to close the vertical opening.

An integral fabric strip may have its ends sewn or otherwise attached to the buttonhole strip (60) to provide an eyeglass hanger for a wearer. Preferably the fabric forming the strip would be the same color and material as that for the rest of the garment (50). Of course a different fabric could be utilized as well.

Turning again to FIG. 3, the garment (50) depicted therein may include a pocket (64). Such a pocket may be defined by a fabric section sewn along its vertical side (66) and (68) and its bottom (70). In this manner a top opening for receiving objects would be defined between the garment and the pocket (64). The pocket may include a pivot or flap (72) sewn to the garment (50) in a line along the top of the pocket (64). Where a pocket has been attached to a garment a fabric strip may be attached to the pocket at any one of a plurality of locations or sewn directly to the garment through the pocket. As illustrated in FIG. 3, a fabric strip may be attached to the pocket or to the flap of the pocket along the top edge of the pocket as illustrated at (74) and (76) or it may be attached to the pocket (64) along the bottom edge thereof as shown at (80). The placement of the fabric strip defining the eyeglass hanger becomes optional with the designer of the garment. In some instances the designer may wish to make the eyeglass hanger as unobtrusive as possible whereas in some instances the designer may wish to accentuate the eyeglass hanger on the garment.

Since certain changes may be made to the above described eyeglass hanger strip without departing from the scope of the invention herein it is intended that all matter contained in the description thereof or shown in the accompanying drawings shall be interpreted as illustrative and not in a limiting sense.

I claim:

1. A fabric garment adapted to be worn upon the upper body portion of a person having a pocket on the front of said garment having top, bottom and side edges, wherein said pocket is stitched to said garment along its side and bottom edges and wherein said pocket includes a horizontally extending top access opening which comprises:

an integral horizontally extending strip of fabric permanently fastened at both ends to an outer face of said pocket, and cooperative with said pocket to define a temple receiving opening for a pair of glasses, wherein said eyeglass hanger strip has a length slightly greater than one-half the perimeter of a pair of glasses taken at the greatest cross-sectional area of a temple to thereby enable said person to insert a single temple of said glasses into the temple receiving opening when said temple is at an acute angle with respect to the bridge portion of the glasses and wherein said eyeglass hanger strip permits said glasses to pivot at the joint between the temple and the bridge as a unit about said eyeglass hanger strip.

2. A fabric garment having a central vertical opening extending down the front of the garment wherein said garment includes a vertical button strip having a plurality of spaced buttons and a vertical buttonhole strip having a plurality of spaced buttonholes adapted to receive buttons from said button strip to thereby close said opening adapted to be worn about the upper body portion of a person which comprises;

an integral horizontally extending strip of fabric permanently fastened at both ends to said buttonhole strip at the front exterior of said garment, overlying said garment to form an eyeglass hanger strip with said garment and cooperative with said garment to define a temple receiving opening for a pair of glasses, wherein said eyeglass hanger strip has a length slightly greater than one-half the perimeter of the temple of a pair of glasses taken at the greatest cross-sectional area of a temple to thereby enable said person to insert a single temple of said glasses into the temple receiving opening when said temple is at an acute angle with respect to the bridge portion of the glasses and to prevent lateral movement of said glasses along said eyeglass hanger strip and wherein said eyeglass hanger strip permits said glasses to pivot at the joint between the temple and the bridge as a unit about said eyeglass hanger strip, said eyeglass hanger strip having a width of less than about 0.500 inches.

3. The garment of claim 2 in which said button strip and said buttonhole strip define a placket extending vertically partially down the front of said garment and wherein said eyeglass hanger strip is positioned immediately beneath the lower end of said placket and wherein said eyeglass hanger strip has a width approximately equal to that of said button strip.

4. A fabric garment adapted to be worn about the upper body portion of a person having a pocket on the front of said garment having top, bottom and side edges, wherein said pocket is stitched to said garment along its side and bottom edges and wherein said pocket includes a horizontally extending top access opening and a fabric flap which overlies said top access opening which comprises;

an integral horizontally extending strip of fabric permanently fastened at both ends to said flap to form an eyeglass hanger strip with said flap and cooperative with said flap to define a temple receiving opening for a pair of eyeglasses, wherein said eyeglass hanger strip has a length slightly greater than one-half the perimeter of the temple of a pair of glasses taken at the greatest cross-sectional area of a temple to thereby enable said person to insert a single temple of said glasses into the opening defined by said eyeglass hanger strip and said flap once the temple is at an acute angle with respect to the bridge portion of the glasses and to prevent lateral movement of said glasses along said eyeglass hanger strip and wherein said eyeglass hanger strip permits said glasses to pivot at the joint between the temple and the bridge of the unit about said eyeglass hanger strip.

5. A fabric garment adapted to be worn about the upper body portion of a person which comprises;

an integral horizontally extending strip of fabric permanently fastened at both ends to the front exterior of said garment and overlying said garment to form an eyeglass hanger strip with said garment and cooperative with said garment to define a temple receiving opening for a pair of eyeglasses, wherein said eyeglass hanger strip has a length slightly greater than one-half the perimeter of the temple of a pair of glasses taken at the greatest cross-sectional area of a temple to thereby enable said person to insert a single temple of said glasses into the opening defined by said eyeglass hanger strip and said garment when said temple is at an acute angle with respect to the bridge portion of the glasses and to prevent lateral movement of said glasses along said eyeglass hanger strip and wherein said eyeglass hanger strip permits said glasses to pivot at the joint between the temple and the bridge as a unit about said eyeglass hanger strip and said eyeglass hanger strip is sufficiently narrow such that the strip will collapse and be accommodated between said temple and said bridge when said glasses pivot about said strip.

6. The garment of claim 1 in which said eyeglass hanger strip extends horizontally adjacent the top access opening of said pocket.

7. The garment of claim 1 in which said eyeglass hanger strip extends horizontally along said stitched portion defining the bottom of said pocket.

8. The garment of claim 1 in which said eyeglass hanger strip is formed from the same material as said garment.

* * * * *